United States Patent [19]

Geishecker

[11] Patent Number: 4,990,830

[45] Date of Patent: Feb. 5, 1991

[54] CURRENT SENSING RELAY

[75] Inventor: Stephen P. Geishecker, East Walpole, Mass.

[73] Assignee: Texas Instruments Incorporated, Dallas, Tex.

[21] Appl. No.: 543,599

[22] Filed: Jun. 25, 1990

[51] Int. Cl.[5] ..... H05B 41/00; H01H 50/24; H01H 50/30; H01H 51/06

[52] U.S. Cl. ..... 315/106; 315/107; 335/127; 335/192

[58] Field of Search ..... 315/106, 107, 283, 284, 315/285, 286, 362; 335/127, 128, 129, 130, 131, 185, 186, 187, 192

[56] References Cited

U.S. PATENT DOCUMENTS

| | | | |
|---|---|---|---|
| 3,866,087 | 2/1975 | Powell | 315/97 |
| 4,009,412 | 2/1977 | Latassa | 315/106 |
| 4,082,981 | 4/1978 | Morton et al. | 315/97 |
| 4,339,690 | 7/1982 | Regan et al. | 315/97 |
| 4,559,478 | 12/1985 | Fuller et al. | 315/224 |
| 4,568,860 | 2/1986 | Feinberg et al. | 315/255 |
| 4,661,745 | 4/1987 | Citino et al. | 315/106 |

*Primary Examiner*—David Mis

*Attorney, Agent, or Firm*—John A. Haug; James P. McAndrews; Melvin Sharp

[57] ABSTRACT

A three pole relay is shown which operates in response to the flow of normal operating current across fluorescent lamps to energizes a coil which actuates a relay to open switches disposed in all of the filament lines associated with the lamp to shut off filament current while maintaining current flow across the lamps themselves.

8 Claims, 3 Drawing Sheets

CURRENT SENSING RELAY

BACKGROUND OF THE INVENTION

1. FIELD OF THE INVENTION

This invention relates to a current sensing relay and, more specifically, to a plural pole relay for magnetically opening a normally closed switch of a circuit upon sensing of a predetermined electrical current.

2. BRIEF DESCRIPTION OF THE PRIOR ART

In accordance with the prior art, filament windings of fluorescent lamps and the like remain in an energized state after lighting of the lamp since there is no provision for cutting off the filament current after commencement of lamp operation. This condition results in waste of energy as well as production of possibly unwanted heat which also must be dissipated in some manner. The prior art has attempted to alleviate this problem in several ways, such as by the use of timers in the filament circuits to cut off current to the filaments after a predetermined period of time. Other solutions to the problem are shown in Latassa U.S. Pat. No. 4,009,412 wherein there is provided a secondary winding to supply lamp current and a tertiary winding to supply heater current wherein a magnetic switch is provided which senses current through the secondary winding and opens the heater current circuit in response thereto. Other prior art of this type is shown in Feinberg U.S. Pat. No. 4,568,860, Citino U.S. Pat. No. 4,661,745, Powell U.S. Pat. No. 3,866,087. These prior art solutions have been subject to one or more of several problems, these including cost, the use of normally open switches wherein the switch must close to ignite the lamps initially and switch failure therefore results in fixture lighting failure. These problems have been overcome in copending U.S. patent application Ser. No. 07/454,592, assigned to the assignee of the present invention, in which there are disclosed and claimed several embodiments of a simple and relatively inexpensive normally closed device to cut off filament current to all starting filaments in fluorescent lamps and the like shortly after commencement of lamp operation. In that application a three pole relay is disclosed which operates in response to the flow of normal operating current across a fluorescent lamp device to energize a coil, the coil actuating the relay to open switches disposed in all of the filament lines associated with the lamps to shut off filament current while maintaining current flow across the lamp itself. In one such embodiment there is provided a can of magnetic material to which is crimped a cover of non-magnetic material to form an enclosure within the can. A coil, which is the ballast efficiency switch (BES) coil of the lamp circuit, is disposed within the can, thereagainst at one end thereof and around a center post of magnetic material. A plastic flange optionally having a shorting turn therein is secured to the other end of the coil. Also positioned within the can and abutting the interior end of the center post is a steel coin which is secured to a plastic disc. The coin/disc and plastic flange are normally biased apart by a compression spring. The center post, can and steel coin form a magnetic circuit whereby, when the coil is energized, the coin is attracted toward the coil and against the bias of the spring. A plurality of normally closed switches are maintained in the closed position by the plastic actuator when the disc is in its normal position. Upon energization of the coil, with the steel coin and plastic actuator being attracted toward the coil and away from the switches, the switches are opened to open circuits in which these switches are connected.

However, when the coil is energized causing the coin to come to its actuated position it results in a higher sound level than is desired. It is an object of the present invention to provide a current sensing relay of the type described above but having a reduced sound level while having improved mechanical stability and magnetic efficiency.

SUMMARY OF THE INVENTION

Briefly, in accordance with the invention, there is provided a can of magnetic material formed with a ledge at its open end. A coil is disposed within the can around a center post of magnetic material. A steel coin secured to a plastic actuator disc is received on the ledge and extends over the center post and is normally biased away from the center post by a compression spring positioned off-center relative to the center post so that an opposite end of the coin serves as a pivot point on the ledge. The center post, can and steel coin form a magnetic circuit whereby, when the coil is energized, the coin is attracted toward the post against the bias of the spring. A plurality of normally open switches are maintained in the closed position by a rib attached to the plastic actuator disc when the disc is in its normal position biased by the spring. According to a feature of the invention the steel coin is configured so that it extends from the ledge where it serves as a pivot for an edge of the coin to a point slightly beyond the center post so that upon energization of the coil the steel coin and plastic actuator are attracted toward the center post and away from the switches to thereby open the switches and the circuits in which the switches are connected. As the coin moves toward a position parallel with the ledge of the can the pivot point moves to two laterally disposed points on the ledge with the actuator disc initially continuing until the plastic actuator engages the ledge on the side of the can where the spring is located or the coin engages a far edge of the center post before assuming a steady state position with the lower surface of the coin slightly beyond a position parallel with the plane of the ledge. According to a second embodiment the pivot point continues to move toward the center post and inwardly an amount dependent upon the radius between the ledge and the side wall of the can.

DESCRIPTION OF THE PREFERRED EMBODIMENTS

Figure 1:
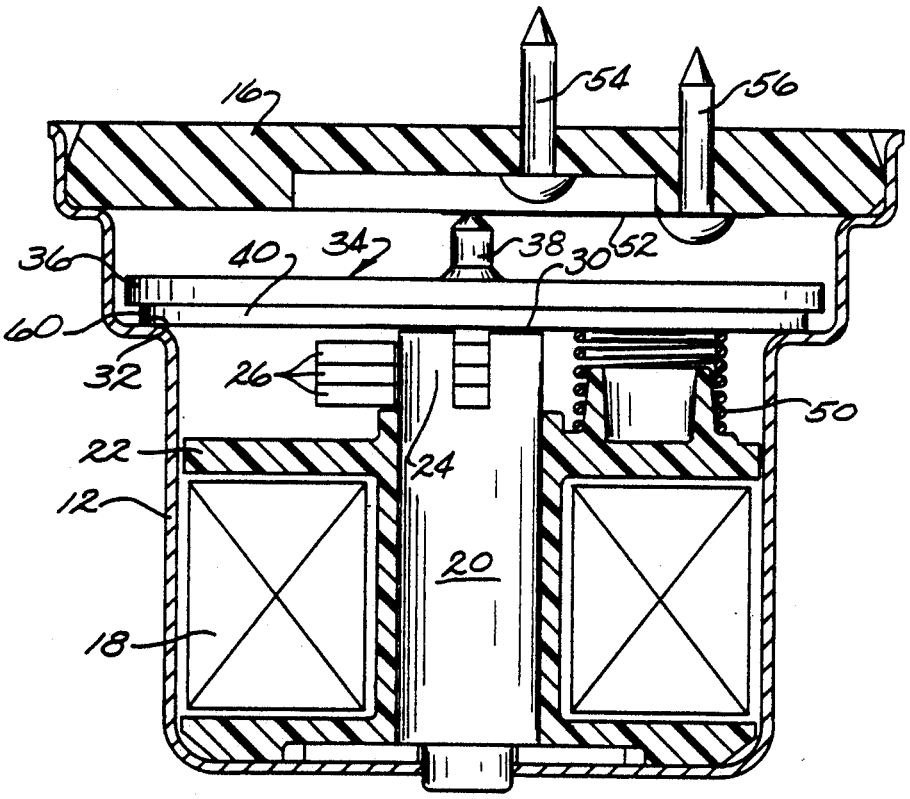
FIG. 1 is a cross sectional elevation of a device made in accordance with U.S. patent application Ser. No. 07/454,592 referenced supra.
Figure 1A:
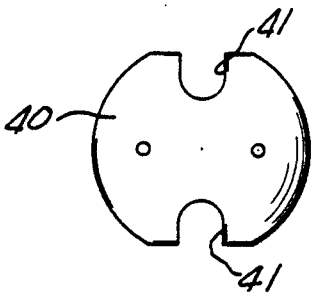
FIG. 1a is a plan view of the coin member employed in the FIG. 1 structure.

Referring to the drawings, FIG. 1 shows a relay as described in U.S. patent application Ser. No. 07/454,592 comprising a can 12 of low magnetic permeability which is attached, as by crimping, to a cover 16 of plastic. Within can 12 is a coil 18 disposed around a center post 20 of low magnetic permeability. Coil 18 is wound on a plastic bobbin 22. A stack of essentially D-shaped members 26 of electrically conducting and low magnetic permeability material is positioned about one section 24 of a bifurcated portion of center post 20. End 30 of center post 20 is located slightly lower than a shelf 32 to provide a selected gap between the center post and a coin to be described below.

Figure 2:
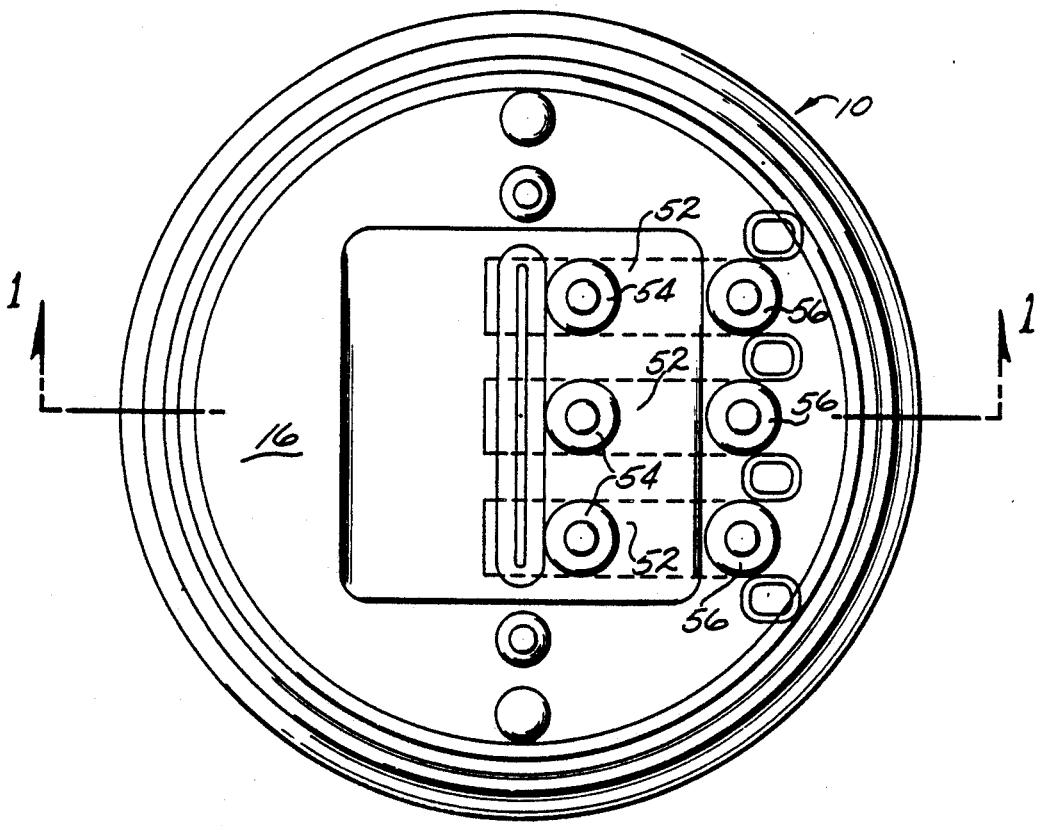
FIG. 2 is a top view of the FIG. 1 device.

An actuator assembly 34 comprising a plastic disc 36 has a rib 38 projecting upwardly from one face thereof extending laterally across a selected portion of the disc aligned with switch elements to be discussed below. Coin member 40 of steel or other suitable material of low magnetic permeability is attached to the opposite face of disc 36 in any conventional manner as by using suitable fasteners. Coin member 40 is essentially a round plate with opposed cut out portions to permit electrical leads to the coil to pass therethrough. Coin member 40 is received on shelf 32 with compression spring 50 disposed between bobbin 22 and actuator disc 36 and normally biases the actuator upwardly causing coin 40 to pivot at point 60 on ledge 32. In its normal up position rib 38 biases movable contact 52 into engagement with terminal 54 to maintain the electrical circuit from terminal 56 to terminal 54 closed. There are three such switches as indicated in FIG. 2, all controlled by actuator 34.

When coil 18 is energized coin 40 is attracted toward center post 20 with actuator 34 pivoting about point 60 on ledge 32 with its motion limited by shelf 32 all around the circumference thereof. Thus when the lamps are fully energized actuator 34 is brought down toward the pole piece against the bias of compression spring 50. However, it is found that the actuator tends to oscillate, primarily due to the cyclical change in force level of the coil, causing a very audible noise which is undesirable. Although this could be mitigated by substantially increasing the force level of the magnet this is undesirable since it typically involves extra space and expense for an enlarged coil or, alternatively, a coil which dissipates higher wattage.

Figure 3:
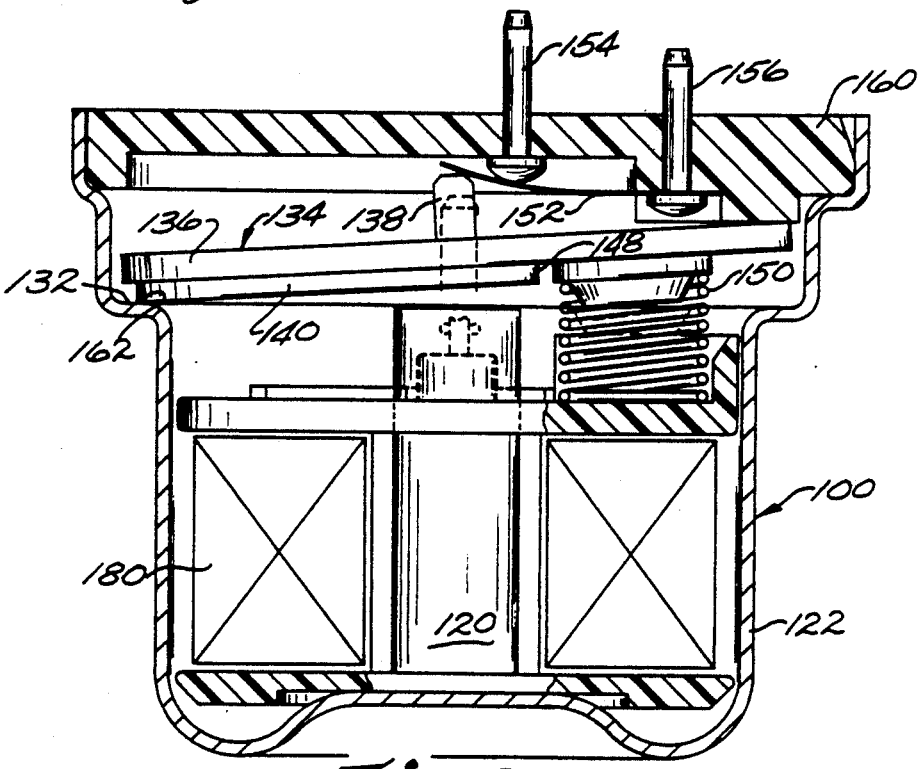
FIG. 3 is a cross section view similar to FIG. 1 of a relay made in accordance with the present invention.
Figure 4:
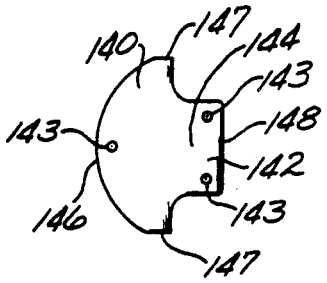
FIGS. 4 and 5 are plan views of two embodiments of coins used in the present invention.

The sound level is greatly reduced in the relay made in accordance with the invention. FIG. 3 shows a relay 100 made in accordance with the invention in the at rest or de-energized condition with actuator 134 biased upwardly by compression spring 150 maintaining movable contacts 152 in closed circuit condition with contact terminal 154 via rib 138. Coin member 140, of steel or other suitable material of low magnetic permeability, is attached to the opposite side of disc 136 in any conventional manner as by staked plastic legs (not shown) extending from disc 136 through appropriate apertures 143 in the coin. As best seen in FIG. 4, coin 140 comprises a generally semi-circular plate having a diameter which is between the inside and outside diameters of ledge 132, a central rectangular portion 142 extending beyond the center 144. The semi-circular perimeter portion 146 is received on ledge 132 with portion 142 extending to a location 148 between center post 120 and compression spring 150. Portion 146 merges on opposite sides thereof with parallel straight edges 147 which extend in a direction which is parallel with an axis passing through pivot point 160, the center of can 120 and compression spring 150.

Figure 6:
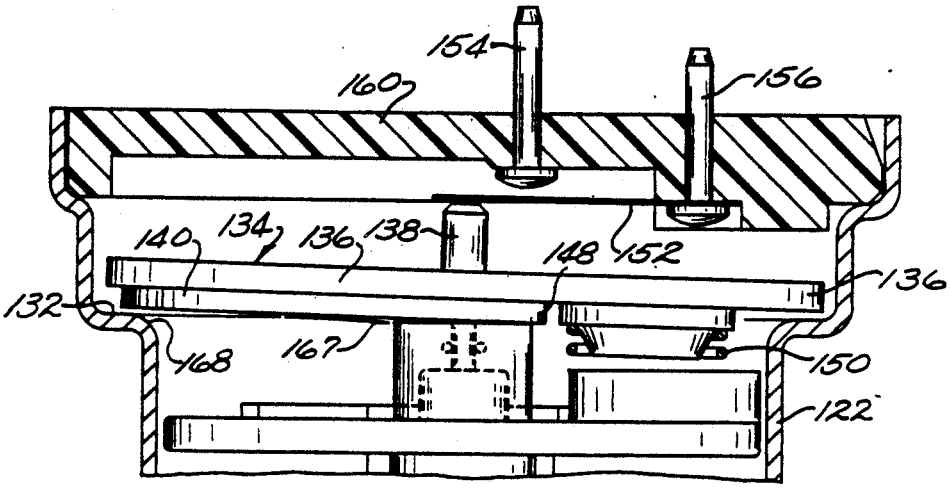
FIG. 6 is a view similar to FIG. 3 of a relay made in accordance with the invention, partially broken away, showing the relay in an energized condition and showing the locus of pivot points associated with the FIG. 4 coin.
Figure 7:
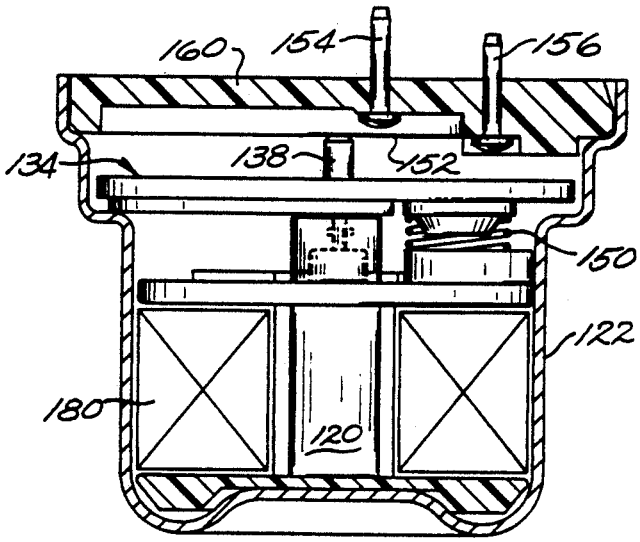
FIG. 7 is a view similar to FIG. 3 of a relay made in accordance with the invention with the coin shown in the position where transition of the pivot location occurs.

When coil 180 is energized coin 140 is attracted toward center post 120 with actuator 134 pivoting about point 160, however as coin 140 passes through the plane in which ledge 132 lies the pivot moves to a locus best seen in FIG. 6 at 167 as edges 147 in effect roll on curved surface 168 of can 120. Initially the movement of actuator 134 will be limited by coin 140 engaging the edge of center post 120 as shown in FIG. 6, or if the gap between the center post 120 and the plane in which shelf 132 lies is sufficiently large, by disc 136 contacting shelf 132. In either event, the actuator will then move to a steady state position with upward and downward forces acting through their respective lever arms being balanced and the lower surface of the coin positioned slightly beyond a position parallel with the plane of the ledge. Reducing the effective lengths of the relevant lever arms from those based on the pivot point 160 to those of locus 167 result in significantly reduced sound level.

Figure 5:
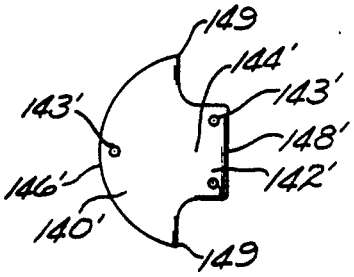

FIG. 5 shows a second embodiment of the coin in which the pivot of the coin moves to two individual points rather than a locus. As seen in the figure, the semi-circular portion 146'extends all the way to rectangular portion 142' so that the pivot of coin 140' moves from point 160 on shelf 132 shown in FIG. 3 to two points 149 disposed laterally opposite one another on the shelf.

Movement of the pivot point of the coin in accordance with the invention results in shorter effective lever arms with a concomitant reduction in sound level, for example from 38 dB to 26 dB.

It will be noted that due to the existence to forces acting both upwardly and downwardly on the actuator the device is insensitive to positional orientation. Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

I claim:

1. A relay for disconnecting fluorescent lamp filaments from an associated filament circuit comprising;

(a) a generally cup shaped housing having a bottom wall and a depending cylindrical side wall, the side wall having a free distal end portion formed with an annular ledge lying in a plane parallel with the bottom wall;

(b) a magnetic flux producing means disposed within the housing, the flux producing means having a center post extending essentially from the bottom wall upwardly to a point slightly below said plane;

(c) actuator means including a coin member of relatively high magnetic permeability disposed within the housing and movable toward the magnetic flux producing means; and (d) a plurality of switches within the housing, each switch including a movable contact and a stationary contact terminal, the actuator means normally biasing each movable contact into engagement with its associated contact terminal to maintain each of the switches in the normally closed state, (e) spring means mounted within the housing to place an upward bias on the actuator means, the actuator means including a plastic disc, the coin member attached to the bottom of the plastic disc, the coin member having an edge received on a given point of the ledge in the normal at rest position and tilting upwardly therefrom along a selected longitudinal axis, the coin member extending from the given point of the ledge to a point beyond the center post but short of the ledge on the diametrically opposite side on said axis, upon energization of the flux producing means the coin being pivotable on said edge at the given point of the ledge, until the coin member moves through the said plane with the pivot shifting to two points on the ledge disposed on opposite sides of said axis.

2. A relay according to claim 1 in which the annular ledge has an inside and outside diameter and the coin member has a generally circular peripheral portion having a diameter between the inside and outside diameters of the ledge with the center of the portion received on the said given point of the ledge.

3. A relay according to claim 2 in which the circular peripheral portion is less than a semi-circle.

4. A relay according to claim 3 in which the circular peripheral portion merges with a straight edge on both sides thereof, the edges extending parallel to the axis and a radius is formed between the ledge and the side wall of the can to thereby result in a locus of pivot points dependent upon the radius the shelf makes with the side wall of the can.

5. A relay for disconnecting fluorescent lamp filaments from an associated filament circuit comprising;

(a) a generally cup shaped housing having a bottom wall and a depending cylindrical side wall, the side wall having a free distal end portion formed with an annular ledge lying in a plane parallel with the bottom wall;

(b) a magnetic flux producing means disposed within the housing, the flux producing means having a center post extending essentially from the bottom wall upwardly to a point slightly below said plane;

(c) actuator means including a coin member of relatively high magnetic permeability disposed within the housing and movable toward the magnetic flux producing means; and (d) switch means within the housing including a movable contact and a stationary contact, the actuator means normally biasing the movable contact into engagement with its stationary contact to maintain switch in the normally closed state, (e) spring means mounted within the housing to place an upward bias on the actuator means, the coin member having an edge received on a given point of the ledge in the normal unenergized position and tilting upwardly therefrom along a selected longitudinal axis, the coin member extending from the given point of the ledge to a point beyond the center post but short of the ledge on the diametrically opposite side on said axis, upon energization of the flux producing means the coin being pivotable on said edge at the given point of the ledge, until the coin member moves through the said plane with the pivot shifting to two points on the ledge disposed on opposite sides of said axis.

6. A relay according to claim 5 in which the annular ledge has an inside and outside diameter and the coin member has a generally circular peripheral portion having a diameter between the inside and outside diameters of the ledge with the center of the portion received on the said given point of the ledge.

7. A relay according to claim 6 in which the circular peripheral portion is less than a semi-circle.

8. A relay according to claim 7 in which the circular peripheral portion merges with a straight edge on both sides thereof, the edges extending parallel to the axis and a radius is formed between the ledge and the side wall of the can to thereby result in a locus of pivot points dependent upon the radius the shelf makes with the side wall of the can.

* * * * *